US006267530B1

(12) United States Patent
Attar

(10) Patent No.: US 6,267,530 B1
(45) Date of Patent: Jul. 31, 2001

(54) REFLECTIVE PAVEMENT MARKER

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 09/419,741

(22) Filed: Oct. 16, 1999

(51) Int. Cl.[7] ..... E01F 9/015
(52) U.S. Cl. ..... 404/16; 404/14
(58) Field of Search ..... 424/12, 14, 15, 424/16

(56) References Cited

U.S. PATENT DOCUMENTS

| | | | | |
|---|---|---|---|---|
| 4,726,706 | * | 2/1988 | Attar | 404/14 |
| 5,137,391 | * | 8/1992 | Ballesteros | 404/6 |
| 5,425,596 | * | 6/1995 | Steere et al. | 404/14 |
| 5,449,244 | * | 9/1995 | Sandino | 404/14 |
| 5,470,170 | * | 11/1995 | Lindner | 404/9 |
| 5,667,335 | * | 9/1997 | Khieu et al. | 404/14 |
| 5,895,725 | * | 4/1999 | Caughlin | 428/542.2 |
| 5,897,271 | * | 4/1999 | Widmer | 404/14 |
| 5,927,897 | * | 7/1999 | Attar | 404/12 |
| 5,957,617 | * | 9/1999 | Delamere | 404/11 |
| 5,959,774 | * | 9/1999 | Benson et al. | 359/530 |
| 5,975,706 | * | 11/1999 | Nakayama | 395/530 |
| 6,045,294 | * | 8/1998 | Hansen | 404/14 |

FOREIGN PATENT DOCUMENTS

| | | | | |
|---|---|---|---|---|
| 004112702 | * | 10/1992 | (DE) | 404/14 |
| WO91/11787 | * | 2/1990 | (GB) | 404/12 |

* cited by examiner

*Primary Examiner*—Robert E. Pezzuto
*Assistant Examiner*—Raymond W Addie

(57) ABSTRACT

A reflective pavement marker having integrally molded one-piece structural body with multiple hollow cavities that are open only at the top reflective faces of the marker, two arcuate sides and integrally sealed planar base surface with textures and discontinuous grooves. This marker provides a device to enhance agglutination to the roadway, improve resistance to flexural stresses due to automobiles impact forces; this is accomplished by maximizing the base surface area for adhesive wetting parameter. The reflective plates are welded on wedge like tops of the partition walls separating hollow cavities from each other. The body can be made of various recycled or virgin structural plastics with high impact resistance and UV stability.

23 Claims, 5 Drawing Sheets

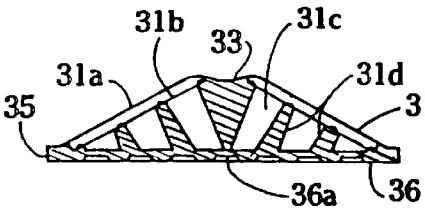
FIG. 4
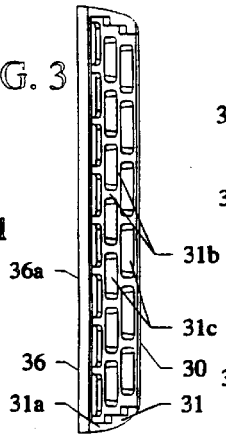
FIG. 3
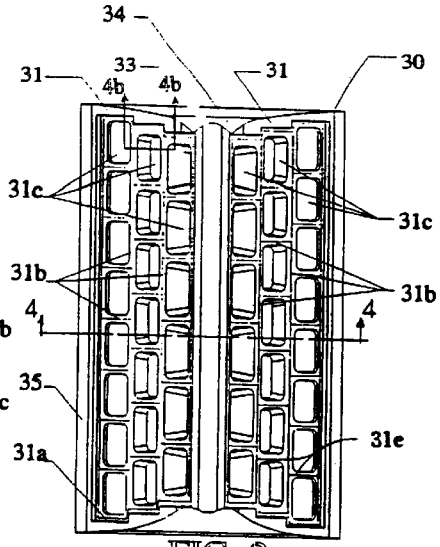
FIG. 2
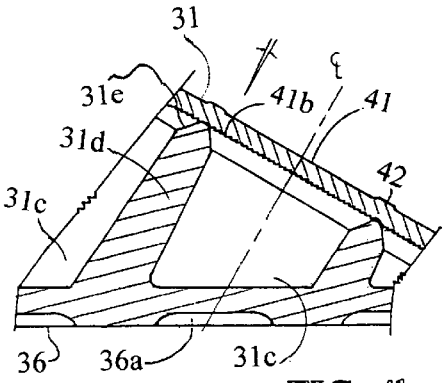
FIG. 4b
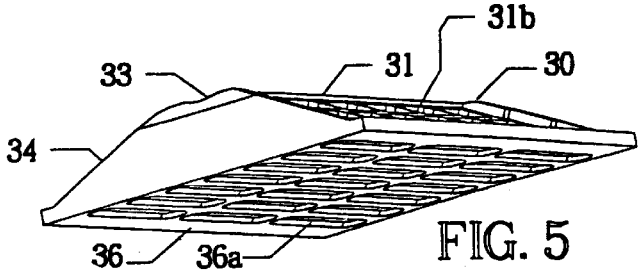
FIG. 5
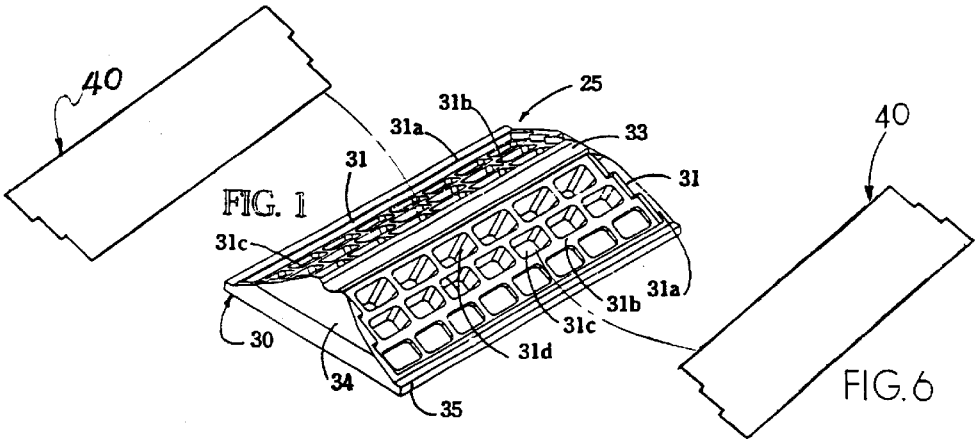
FIG. 1
FIG. 6

FIG.12A
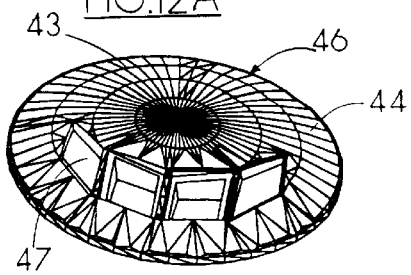
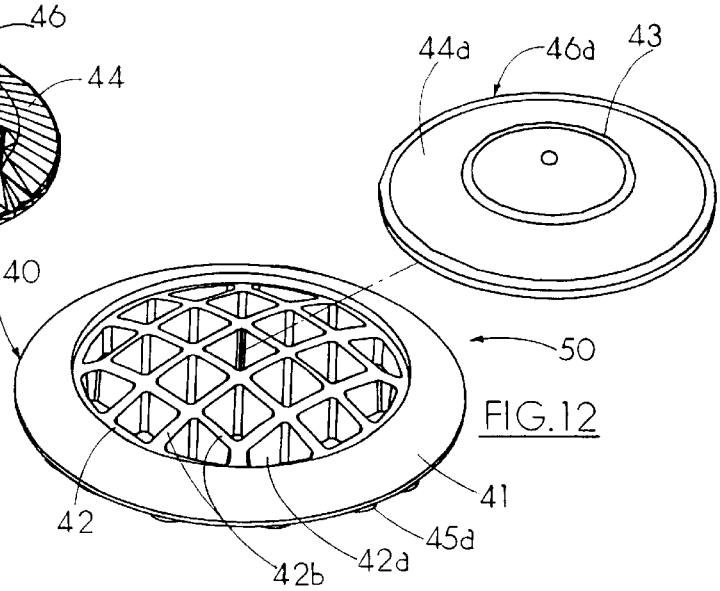
FIG.12
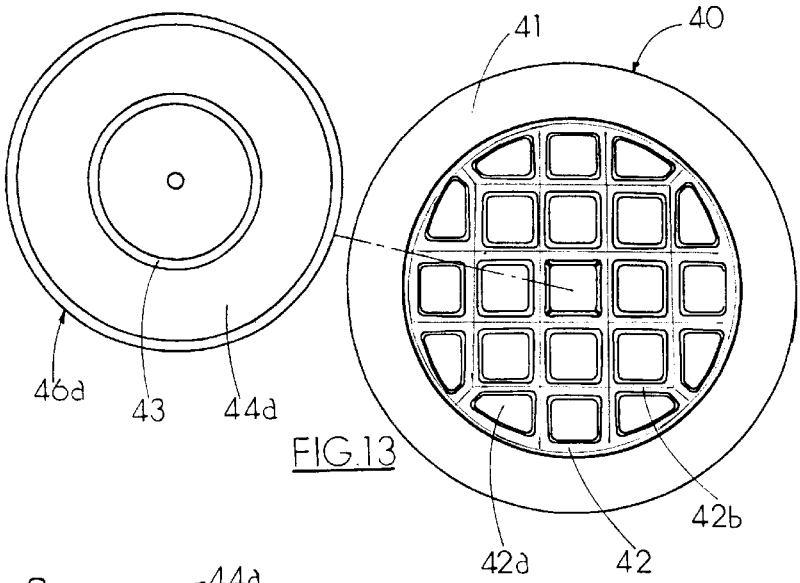
FIG.13
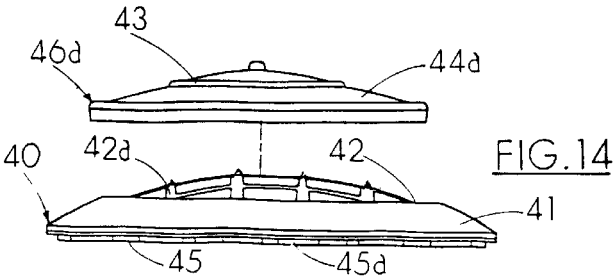
FIG.14

REFLECTIVE PAVEMENT MARKER

BACKGROUND OF THE INVENTION

1. Field of the Invention

This invention relates to reflective roadway markers that are used for traffic lane delineation, in particular, to markers with enhanced reflectivity, impact resistant and low cost.

2. Related Art Roadway markers are adhered to pavements along centerlines, edge lines, lane dividers or guardrail delineators. Other roadway markers are used as temporary lane dividers in temporary constructions, detours or prior to permanent marking of newly paved roadways. Since 1965, the most commonly used reflective roadway markers are based on Heenan U.S. Pat. No. 3,332,327 or Balint U.S. Pat. No. 3,409,344. Typically, this type of markers are produced in a process consisting of four to five steps: First, injection molding of a thermoplastic shell, either integrally molded with the reflective face, or the reflective faces welded on a corresponding open recesses within the shell. The reflective face, having 350 or more cube corner reflective elements on each reflective face of the shell. Secondly, either the cube corner reflective elements within a shell or the entire inside surface of the shell coated with a reflective sealer by a process known as vacuum metalizing. This metallic sealer needed to seal the cube corner reflective elements so they retain part of their reflectivity prior to the next step, of filling the shell with a thermosetting resinous material, such as epoxy or polyurethane.

This resinous filler material encapsulate the metalized cube corner reflective elements and give the marker the structural body. Finally, a layer of relatively course sand or glass beads dispersed over the top surface of the filler material prior to solidification of the filler material.

Part of the sand particles will remain partially protruding above this planar surface of the marker base, thereby increase the adhesive wetting parameter of the base surface. This will improve adhesion to substrate, regardless of the type of adhesive used. This type of markers worked well for six or seven months, however, due to poor abrasion and impact resistant of the thermoplastic shell, nearly 60% of the reflectivity is lost thereafter, Also, since the coefficient of thermal expansion of the shell material and the resinous filler material vary, this causes pealing of the reflective face or the shell from the resinous body, thereby losing reflectivity. Several attempt were made to improve abrasion resistant of the reflective face. One was the thin layer of glass, in U.S. Pat. No. 4,340,319, Another attempt was the use of polymeric coating of the reflective face, as described in U.S. Pat. No. 4,753,548 (Forrer). These abrasion resistant coating proving to be expensive and tend to reduce reflectivity. Other major development in the pavement marker art have been made in the attempt to eliminate the use of the metalized sealer for the cube corner reflective elements. This has been achieved by dividing the inside surface of the reflective face into reflective cells, each cell will have several cube corner reflective elements, the cells isolated from each other by partition and load carrying walls. The entire reflective face welded to corresponding recesses within a hollowed or solid body. This method is disclosed in U.S. Pat. Nos. 4,227,772 (Heenan); 4,232,979; and 4,340,319 (Johnson et al); 4,498,733 (Flanagan). These markers proved to be superior in reflectivity, however, lack of enough adhesive wetting parameter lead to poor adhesion to roadways, hence caused short life cycle for this type of markers. This applicant successfully developed two markers with non-metallized multi-cell reflective roadway. One roadway marker utilizes raised rhombic shaped abrasion reducing and load transferring raised ridges, which act to intercede abrasion elements and impact load, the shell filled with impact resistant epoxy. The marker body having a base with large wetting parameter for shear and flexural strength, as disclosed in U.S. Pat. No. 4,726,706.

The second roadway marker of this applicant, U.S. Pat. No. 5,927,897 developed a mean to increase the abrasion resistant of the reflective face by coating the reflective face with diamond-like film and by having holding pins extended beyond the partition walls into the body, the holding pins sealed by the filler material; this works very effectively, providing structural strength and maximum adhesive wetting parameter. The entire above reflective pavement markers are incorporated herein by reference in their entireties. Applicant present goal to have a roadway marker having: high reflectivity, enhance structural body, abrasion resistant, low cost, marker base area with maximum wetting parameter and very simple yet consistent process to manufacture.

SUMMARY OF THE INVENTION

This invention provide a novel raised pavement marker that comprises a monolithically injected body with hollow cavities, said hollow cavities with open ends at the reflective faces. At least one reflective face having insert plate with multiple cube corner reflective elements welded on it thereby forming air gaps beneath the reflective elements, said body having a base with large adhesive wetting parameter for better adhesion to the pavement and higher resistance to flexural stresses.

The primary object of this invention is to eliminate the multi steps process in prior arts for making reflective and non-reflective pavement markers while retaining maximum base surface area. Another objective of this invention is to provide a raised roadway marker made of high impact and abrasion resistant material and low cost. The present invention further provide a method of making one piece body for raised roadway markers of any desirable shape and configuration having light weight, such as a marker with truncated body or one piece marker with a body having two rumble portions integrally made with two reflective faces and scalloped recess in-between having planar textured base.

In accordance with still further aspect of this invention, the marker can be made with one or two reflective faces, this will cost considerably less to install to the roadway, or two multi colored parts can be welded together, each with one reflective face opposite the other.

BRIEF DESCRIPTION OF THE DRAWINGS

The advantages and unique features of this invention will be better understood by reference to the drawings. These drawings are schematics, no scale used. In the drawings:

FIG. 1 is an isometric view of one of the preferred one-piece marker body of the invention;

FIG. 2 is a plan view of the pavement marker illustrated in FIG. 1;

FIG. 3 is elevation view of pavement marker in FIG. 1;

FIG. 4 is a cross section view taken along the line 4—4 in FIG. 2;

FIG. 5 is isometric view of marker in FIG. 1 showing planar base surface with discontinuous grooves;

FIG. 6 is an isometric view of a reflective plate for attachment in the one piece body of marker in FIG. 1;

FIG. 12 is an isometric view of yet another embodiment of a spherical marker of the invention showing two cap portions, one with reflective cells and the second with no reflective cells;

FIG. 13 is a plan view of the marker body and a non-reflective cap portion for the body, as in FIG. 12;

FIG. 14 is an elevation view of the body in FIG. 12 with one unattached cap portion, as in FIG. 12;

DETAIL DESCRIPTION OF PREFERRED EMBODIMENTS

Figure 7:
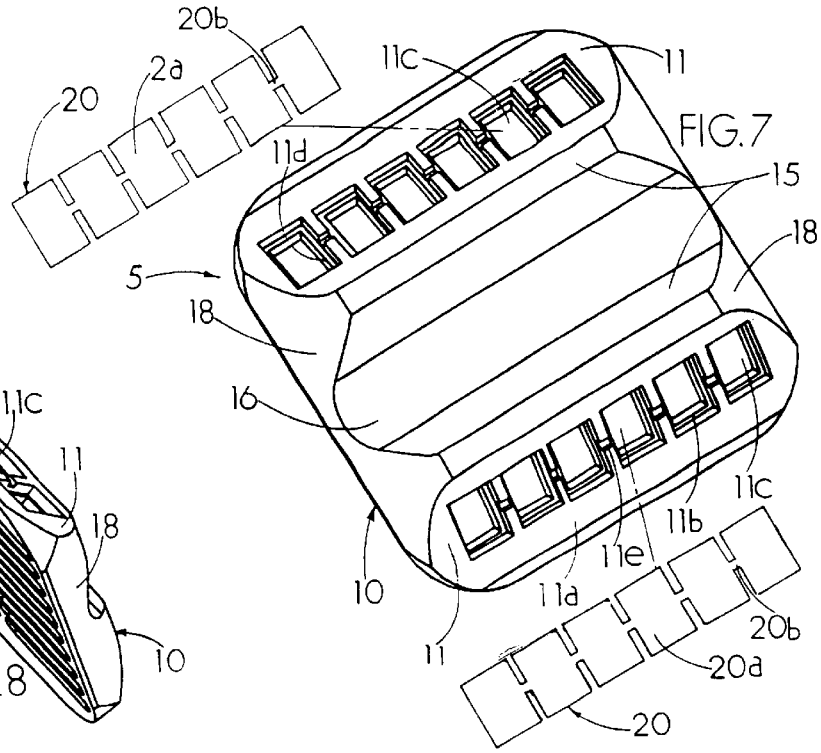
FIG. 7 is isometric view of another embodiment of marker with one-piece body of the invention.

Durable, cost effective and simplified production method for reflective and non-reflective roadway markers with maximum resistance flexural stresses can be achieved by having a large wetting parameter surface within the marker base area and producing a lightweight marker body integrally, in one step, from one of various available structural polymers. The marker body can be integrally formed in such a way as to reduce excessive material loss while retaining structural strength and optimum adhesive wetting area for the base surface. This invention satisfies the above conditions.

Referring to FIGS. 1 to 6, which represent one of the preferred embodiments of the marker designated by the number 25 which comprises a one piece structural body 30 which includes multiple, hollow cavities 31*c* and at least one reflective plate attachment 40. Structural body 30 integrally having two inclined planar faces 31 for reflective plate attachment 40, two arcuate sides 34, a top portion 33 and sealed planar base surface 36 that includes multiple, textured, arcuate grooves 36*a*. The inclined faces 31, each having a planar surface 31*a* and a recessed portion 31*b* where a reflective plate 40 can be welded or agglutinated. Recessed portion 31*b* is where the wedge shaped top surfaces of the hollow cavity walls 31*d* are located. Hollow cavities 31*c*, each having centerline near perpendicular to the inclined planar faces 31. FIG. 4*b* shows a section view of a hollow cavity 31*c* showing wedge shaped top surfaces 31*e* of cavity walls 31*d*, each wall 31*d* forming an angle, preferably about 2 to 5 degrees with respect to the center line of said hollow cavity. Hollow cavities 31*c* having a depth that can be terminated about 0.10 to 0.15 inch above the sealed outside planar base surface 36, which has an extended lip 35. This depth for hollow cavities 31*c* allows body 30 to retain a solid base surface, without any opening for said hollow cavities. The thickness of hollow cavity walls 31*d* at the lower end of wedge shaped top surface 31*e* is about 0.07 to 0.20 inch at the planar recess portion 31*b* of the inclined planar face 31.

These relatively thick, walls 31*d*,with the wedge shaped top surfaces 31*e* will significantly improve the impact resistance of body 30 while maximize the air gap areas beneath each cell shaped remains of the inside surfaces of reflective plate attachment 40.

The inclined planar faces 31 form an acute angle with respect to the planar base surface 36, said acute angle, preferably having a value of about 28 to 30 degrees. The reflective plate attachment 40 is welded to the wedge shaved top surfaces 31*e* of hollow cavity walls 31*d*, fusing a thin portion of the inside of reflective plate attachment 40, thereby forming a cell like reflective segments within the inside surface of plate 40. Each of said cells having multiple cube-corner reflective elements 41*b* freely open within each corresponding hollow cavity 31*c*. The air gap formed beneath the cube corner reflective elements within each hollow cavity 31*c*, allows maximum reflectivity out the need for metalizing the reflective elements. The outside surface of the reflective plate attachment 40 will have corresponding cell like planar reflective areas 41, need having similar shaves as the open ends of hollow cavities 31*c* bellow them. Preferably, the outside cell like planar areas 41 will be recessed about 0.001 to 0.010 inch bellow the planar surface of the reflective plate attachment 40, defining ridge like walls 42. Several shapes or sizes of hollow cavity 31*c* can be selected for marker body 30, hence forming corresponding shaped cell like planar reflective areas 41 for the reflective plate 40.

The following U.S. Patents provides suitable reflective plate or cube corner reflective element design. U.S. Pat. No. 3,712,706 to Stamm, U,S. Pat. No. 4,208,090 to Heenan, U.S. Pat. No. 4,232,919 to Johnson, U.S. Pat. No. 4,498,733 to Flanagan and U.S. Pat. No. 4,726,706 to Attar, all of which are incorporated herein by reference in their entireties. Reflective plate 40 can be coated for abrasion resistance, using suitable method of vapor deposited, diamond-like carbon film or silicon dioxide film. Pavement marker body 30 can have any commonly used size or shape for the base area 36. Preferably, the base are will have a width of about 4.0 to 5.0 inch and the depth to be about 2.0 to 4.0 inch and the marker body height can be about 0.50 to 0.70 inch.

Several recycled or virgin polymeric material are available and suitable for the production of marker body 30. Pigmented and inert filled thermo set or thermoplastic material can also be used to form marker body 30. Preferably, a comparable polymer is used to allow the sonic welding of two parts, the reflective plate means and the marker body 30.

The polymer material used to make the reflective plates 40, normally is transparent acrylic or polycarbonate thermoplastic.

Figure 8:
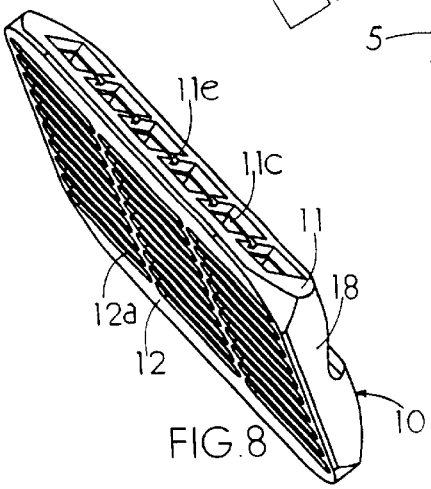
FIG. 8 is another isometric view of marker in FIG. 7 showing the planar base surface with grooves.
Figure 10:
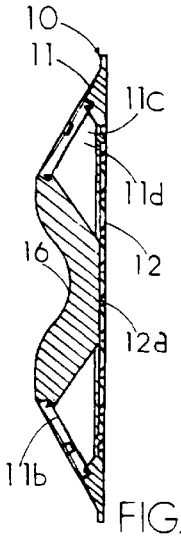
FIG. 10 is a cross section view taken along the line 10—10 in FIG. 9.
Figure 9:
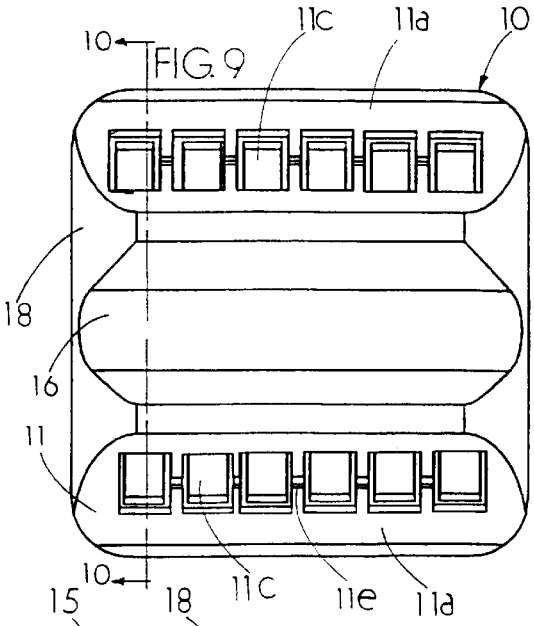
FIG. 9 is a plan view of the marker in FIG. 7 showing the curved sides and reflective face.
Figure 11:
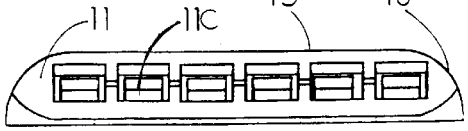
FIG. 11 is an elevation view of the reflective marker in FIG. 7.

Referring to FIGS. 7 through 11, there is shown an alternative embodiment of a roadway marker 5 having a body 10 integrally formed from any desired structural polymer, said marker body 10 having two hump portions 15, each integrally having a concave-curve-shaped reflective face 11 with curved surface 11*a*, open ends of hollow cavities 11*c* and small recesses 11*e*. The two hump portions 15 are integrally connected by a scalloped, recessed-portion 16. The marker body also having two arcuate sides 18 and a sealed planar base surface 12 having a textured and grooved surface 12*a*. Hollow cavities 11*c*, each having a wedge shaped top surface 11*b* slightly recessed bellow the curved surface 11*a* and inwardly tapered partition walls 11*d*. Hollow cavities 11*c* have closed ends that terminate about 0.10 to 0.15 inch above the sealed outside planar base surface 12, The centerline of each hollow cavity 11*c* makes an angle of about 28 to 32 degrees with respect to the planar base surface 12. Reflective plate 20 having multiple reflective cells 20*a*, said cells interconnected with thin ties 20*b*. Plate 20 can be welded or agglutinated to the wedge shaped top surfaces 11*b*. Each individual reflective cell 20*a* tightly welded on to the corresponding wedge shape top surfaces 11*b*. Reflective cells 20*a*, each having an outside planar surface that will be positioned slightly bellow the curved surface 11*a* and having an inside surface with cube corner reflective elements sealed within an air gap inside of each corresponding hollow cavities 11*c*. Reflective plate 20 can be coated with abrasion resistant diamond-like carbon film, or silicone dioxide film, to enhance durability.

Figure 16:
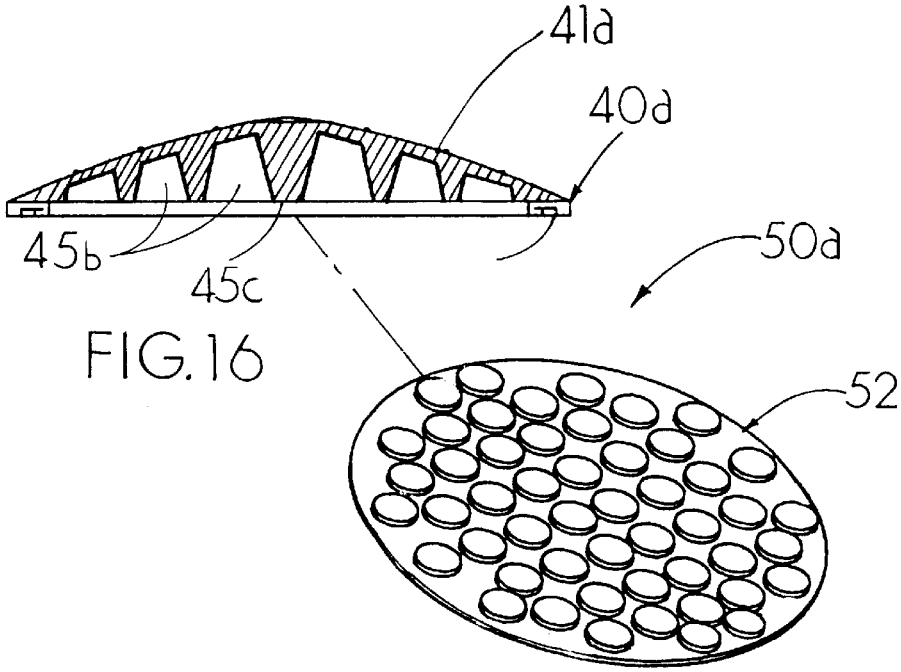
FIG. 16 is a cross sectional view taken along the line 16—16 in FIG. 15.
Figure 15:
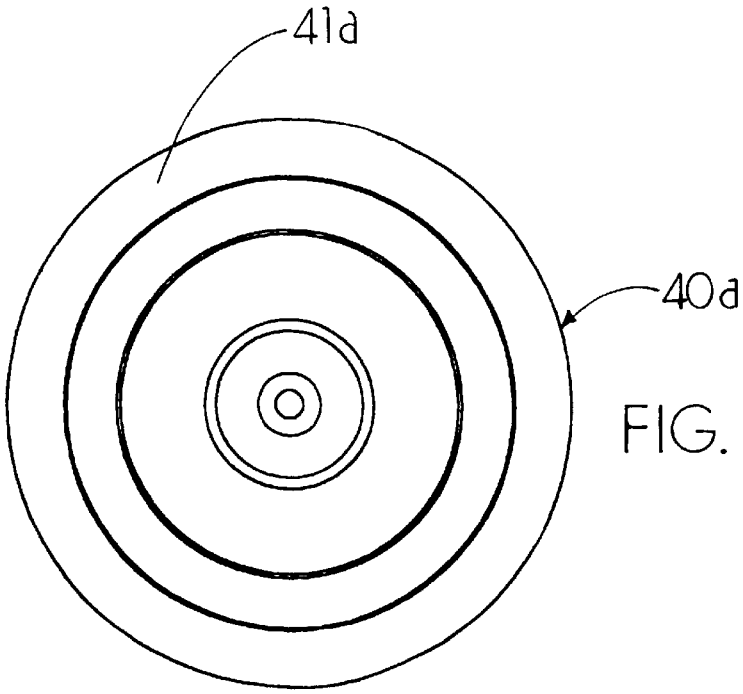
FIG. 15 is a plan view of yet another non-reflective embodiment of the marker of the invention.
Figure 17:
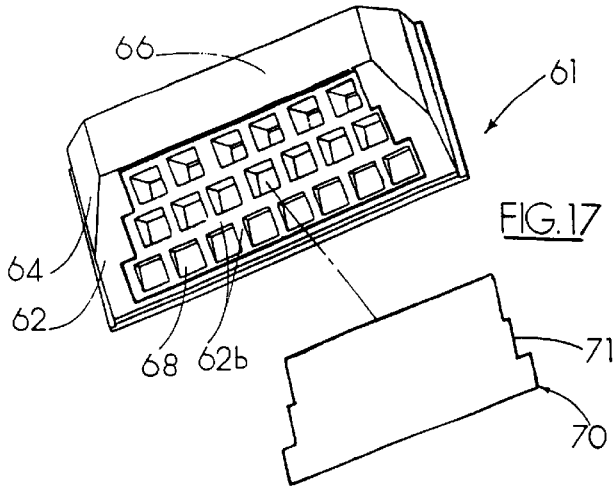
FIG. 17 is an isometric view showing part of another preferred embodiment of the invention.

FIGS. 12 through 16 illustrate yet another embodiment of reflective or non-reflective roadway markers, in accordance to the present invention. Marker 50 has an integrally made body 40 having a round spherical shaped top surface 41 with a round and slightly recessed center portion 42, said center portion 42 is divided into multiple hollow cavities 42*a* by partition and load carrying walls 42*b*. Walls 42*b* are tapered inward, forming 3 to 5 degrees angle with respect to the centerline of each hollow cavity 42*a*. Hollow cavities 42*a* terminate about 0.10 inch above the sealed outside planar base surface 45 with raised pens 45*a*, said raised pens 45*a* protrude less than 0.06 inch beyond the sealed planar base surface 45. When cap portion 46*a* is attached to body 40, a non-reflective marker 50 is formed. Cap portion 46*a* has thickness and contour correspond to the recessed center portion 42 of body 40. Cap portion 46*a* having an outside surface with raised ridges 43. FIG. 12A shows cap portion 46. Cap portion 46 having an outside spherical surface 44 integrally built with raised ridges 43 and multiple of reflective cells 47, each cell having a planar outside surface and multiple cube corner reflective elements on the inside of said cells 47. The inside surface of cap portion 46 can be integrally textured with either small spherical shaped surfaces, wedged ridges, cube corner shaped surface or any combination of such texturing surface for added brightness and welding parameter. When cap portion 46 to be used, the entire shape and size of the hollow cavities 42*a* have to be formed to correspond to the size and shape to cells 47. Reflective cells 47 having the outside planar surface positioned about 28 to 30 degrees with respect to the planar base surface 45. Each reflective cell also forms an angle with respect to adjacent cell, said angle to have a value of not more than 30 degrees. Each cell 47 welded directly on the vertex of wedge shaped top surfaces of hollow cavity walls 42*b*, thereby forming air gap directly beneath the cube corner reflective elements within each cell. Cap portion 46 can be made of impact resistant and transparent polymeric material. Such polymeric materials are available either as a recycled or virgin. When color reflectors are desired, a transparent pigment will be added to the polymer.

Marker 50*a* is another preferred embodiment of a non-reflective marker based on the present invention. Marker 50*a* can be made from recycled or virgin plastics such as ABS, Polypropylene, engineered plastic or any suitable high strength polymer. Engineered plastic is commonly referred to as thermosetting or thermoplastic polymers with various proportions of fiber reinforcement and/or inert materials added. Several compositions of these types of polymers are available and readily marketed, either as a recycled or virgin polymer. Marker 50*a* having a one-piece body 40*a* with a sealed spherical top surface 41*a*, said body 40*a* including multiple, hollow cavities 45*b*, each with an open end at a recessed part 45*c* of planar base surface 45*a*. Each hollow cavity 45*b* ends approximately 0.10-inch bellow the outside spherical surface 41*a*. A planar cap portion 52 can be welded to the recessed part 45*c* of the planar base surface 45*a* where the open ends of hollow cavities 45*b* are located. These types of reflective and non-reflective markers can effectively be used to replace the highly brittle ceramic markers, because it can retain surface brightness due to having minimum contact to tire surfaces, maximum base adhesive wetting parameter and lower production cost and shorter production cycle due to the multiple hollow cavities within the marker's body. Markers 50 and 50*a* can be coated with abrasion resistant vapor deposited diamond like film or silicon dioxide film for added surface enhancement and durability.

Figure 18:
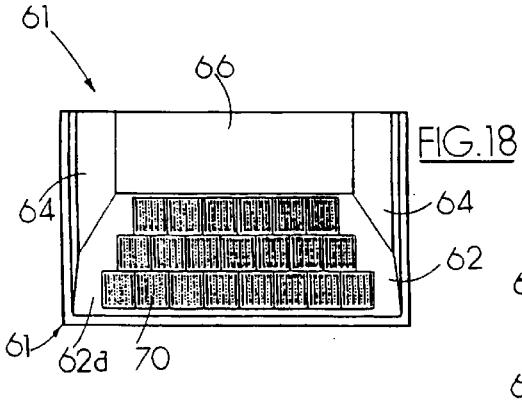
FIG. 18 is a plan view of the reflective marker part in FIG. 17 with attached reflective plate.
Figure 19:
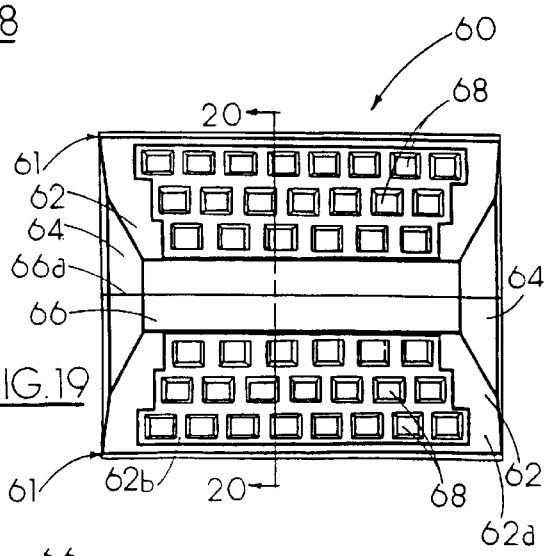
FIG. 19 is a plan view of welded two parts forming two ways marker based on FIG. 17 part.
Figure 20:
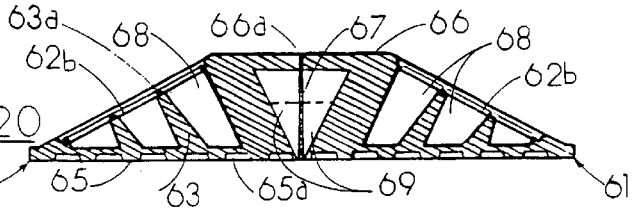
FIG. 20 is a cross section of the combined two parts as in FIG. 19, taking along line 20—20 in FIG. 21.

Another preferred embodiment is roadway marker 60, as illustrated in FIGS. 18 through 22. Marker 60 is ideally suited for use having two multi colored reflective sides or a one-color marker. Marker 60 formed having two parts 61 connected with a tear-able thin wedge 66*a*. The two parts 61 can be welded or agglutinated at the backside 67.

Each part 61 integrally comprises a planar top surface 66, a sealed planar base surface 65 with textured grooves 65*a*, two multi angled sides 64, an inclined planar face 62 and backside 67 vertical with respect to planar base surface 65, said backside including hollow cavities 69.

The inclined planar face 62 includes a planar surface 62*a* and a recessed portion 62*b*. Recessed portion 62*b* having the open ends of hollow cavities 68 and the wedge shaped top surfaces 63*a* of hollow cavity walls 63 that separate said hollow cavities from each other. The planar face 62 is preferably inclined about 28 to 30 degrees with respect to the sealed planar base surface 65. A reflective plate 70 which has a corresponding size and shape of the recessed portion 62*b* is either welded or agglutinated to the wedge shaped top surface 63*a*, thereby retaining cell like inside areas of the reflective plate with cube corner reflective elements, tightly within an air gap, inside each corresponding hollow cavity 68. Hollow cavities 68 are formed having a centerline near perpendicular to planar face 62 and a depth that terminates about 0.10 inch above the planar base surface 65.

Hollow cavity walls 63 form an inward angle equal or less than 5 degrees with respect to each centerline of the corresponding hollow cavity.

Another form of hollow cavities 69 open within the backside 67, said cavities 69 can be of any eject able shape. Hollow cavities 69 are used to minimize any wasted polymeric material used to make part 61 without hampering the structural integrity of said part 61. Part 61 can be made of various recycled or virgin polymeric materials with the desired color added. Reflective plate 70 can have either planar outside surface or slightly recessed cell like planar surfaces corresponding to the shapes of the opening of the hollow cavities 68.

The inside surface of reflective plate 70 is formed with multiple cube-corner reflective elements. The inside of reflective plate 70 is sonically welded to the wedge shaped top surface 63*a* of hollow cavity walls 63. Hence cell-like areas formed on the inside surface of reflective plate 70. Each cell can retain multiple of the cube-corner reflective elements within a corresponding hollow cavity 68.

Either two reflective lenses can be sonically welded to each recessed side, or one blank plate can be welded to one side and reflective plate on the opposite.

The present descriptions are considered to be few of the preferred embodiments of this invention. It is understood that various changes or modification can be made within the scope of the appended claims all such modification fall within the true spirit and scope of the invention.

Therefore, the invention can be practiced otherwise than as specifically described herein.

What is claimed is:

1. A reflective roadway marker having a one piece body with at least one reflective plate means for attachment, said one piece body comprising:

multiple hollow cavities, two arcuate sides, a top portion, a sealed planar base, said sealed planar base having a bottom surface with textured, disontinous grooves and two inclined planar faces, each of said planar faces having a planar recessed portion where the open ends of hollow cavities are located and where one reflective plate means can be attached, said planar recessed portions having the top ends of load carrying partition walls defining said hollow cavities within one said piece body, each of said top ends of load carrying partition walls is having a wedge shaped top surface, said wedge shaped top surfaces are being adopted for structural enhancement and to maximize the air gap areas at the open ends of said hollow cavities, said load carrying partition walls each having inwardly formed angle of about 2 to 5 degrees with respect to the center line of said corresponding hollow cavity; and reflective plate means for attachment to the top portions of said wedge shaped top surfaces and periphery of said planar recessed portion of said inclined planar faces of said one piece body, said reflective plate means having inside surface with multiple of cube-corner reflective elements and planar outside surface, said inside surface sonically wedded to said wedge shaped top surfaces thereby fusing a portion of said cube corner reflective elements to said wedge shaped top surfaces thereby defining cell like inside surface upon the reflective plate means, each said cell having the remaining cube corner reflective elements, said planar outside surface can be divided into slightly recessed cell like planar surfaces.

2. The roadway marker is defined in claim 1, wherein each inclined planar face integrally includes a recessed portion where a reflective plate means is attached, said recessed portion includes the wedge shaped top surfaces of said load carrying partition walls, said wedge shaped top surfaces having a base width of about 0.07 to 0.20 inch near said planar surface of said recessed portion of each said inclined planar faces.

3. The roadway marker is defined as claim 1, where said hollow cavities are integrally formed having centerlines near perpendicular to the corresponding inclined planar faces within the one-piece body, said hollow cavities having depths that terminate about 0.10 to 0.15 inch above said sealed planar base surface.

4. The roadway marker is defined in claim 1, wherein the said grooves have a depth of about 0.03 to 0.08 inch.

5. The reflective roadway marker as defined in claim 1, wherein the one piece structural body can be made various compatible polymeric materials, said material can be recycled or virgin polymer with high impact resistance, said polymeric material can be filled with additive filler materials for strength or pigmentation.

6. The roadway marker is defined in claim 1, wherein the reflective plate means is made of transparent polymeric material, said reflective plate means can have slightly recessed cell like outside planar surfaces of about 0.002 to 0.008 inch deep and inside surface with multiple cube corner reflective elements, said inside surface of said reflective plate means is sonically welded to te top ends of said wedge shape top surfaces forming reflective cell like surfaces within each hollow cavity, each of said cell like surfaces retaining multiple cube-corner reflective elements.

7. The reflective roadway marker as defined in claim 1, wherein the outside surfaces of the reflective plate means can be coated with a layer of abrasion resistance diamond like carbon film or silicon dioxide film, utilizing evaporative coathing methods.

8. A retro reflective roadway marker comprising:

one piece structural body and at least one reflective plate attachment, said one piece body integrally formed comprising:

a sealed planar base surface with textured sincontinous grooves, two arcuate sides, a top side having two hump portions each having a concave curve shaped reflective face, a plurality of hollow cavities integrally formed within said one piece body, said reflective face having the top planar open ends of said hollow cavities within a planar recessed portion, said hollow cavities being defined by load carrying partition walls having recessed wedge shaped top surfaces for reflective plate attachment, said two hump portions connected by a center concave recess portion.

9. The reflective roadway marker as defined in claim 8, wherein at least one reflective plate attachment is welded or agglutinated to said recessed wedge shaped top surfaces within said reflective faces of said one-piece body.

10. The reflective roadway marker as defined in claim 8, wherein the reflective plate attachment is made of transparent polymeric material having inside surface with multiple of cube corner reflective elements, a portion of said cube corner reflective elements being welded to said recessed wedge shaped top surfaces of said load carrying partition walls, thereby defining a cell like reflective areas within said hollow cavities.

11. The reflective roadway marker as defined in claim 8, wherein the one piece body can be made of recycled or virgin engineering plastic or any suitable structural polymeric material with high impact resistance, said polymeric material to be compatible for sonic weilding to said reflective plate material.

12. A roadway marker comprising of one piece structural body and one reflective plate attachment, said one piece structural body is formed having spherical shaped upper surface, said upper surface integrally formed with inwardly tapered load carrying partition walls defining multiple hollow cavities integrally within said one piece body, said load carrying partition walls having wedge shaped top surfaces within a recessed portion of said spherical shaped upper surface of said one piece body, said one piece body having an integrally sealed planar base surface with raised pens.

13. The roadway marker as defined in claim 12, wherein the one piece structural body is having the wedge shaped top surfaces at the ends of said integrally formed load carrying partition walls defining said hollow cavities within a recessed spherically shaped portion of said spherical shaped upper surface of said one piece structural body, said one piece body made of high impact resistance recycled or virgin polymeric material.

14. The roadway marker as defined in claim 12, wherein a cap portion welded or agglutinated to the corresponding recessed spherical portion of said one piece body, said cap portion integrally having raised ridges on the outside spherical surface and can have two opposing sides with multiple or planar reflective cells, each reflective cell integrally having inside surface with multiple of cube corner reflective elements, said reflective cells each forms nearly 30 degree angle with respect to planar base surface and each reflective cell forms a horizontal angle of not more than 30 degrees with respect to adjacent cell, said cap portion made of recycled or virgin transparent polymer.

15. The roadway marker as defined in claim 12, wherein the cap portion for said one piece body can be made without reflective cells, said cap portion can be made of various compatible recycled or virgin pigmented polymers.

16. The roadway marker as defined in claim 12, wherein the one piece structural body can be formed with sealed upper spherically shaped surface, said one piece structural body having the open ends of said hollow cavities integrally open within a recessed portion of the planar base surface, said load carrying partition walls having inwardly tapered surface with respect to the planar base surface, said one piece body can be made of recycled or virgin high impact resistance and U.V. stabilized polymer.

17. The roadway marker as defined in claim 16, wherein an attachment planar thin cap portion welded or agglutinated to be recessed portion of said planar base surface, said planar thin cap portion made of compatible recycled or virgin polymeric material, said planar thin cap portion having textured discontinous grooves on the outside surface.

18. The reflective roadway marker as defined in claim 12, wherein the upper spherical shaped surface can be coated with abrasion resistant diamond-like carbon film or silicone dioxide film utilizing a suitable vapor deposition method.

19. A retro reflective roadway marker comprises:

a structural body formed by welding two identical parts integrally connected by a tear able thin wedge, each of said part having a top surface, a textured and sealed planar base surface, two multi-angled sides, one inclined planar face surface with a planar recessed portion, a beaded and hollowed backside forming perpendicular angle with respect to said sealed planar base surface and integrally formed load carrying partition walls defining multiple hollow cavities within each of said part, said load carrying partition walls having open ends with wedge shaped top surfaces within said planar recessed portion of said part; and reflective plate means for attachment to said wedge shaped top surfaces of said load carrying partition walls defining multiple hollow cavities within said planar recessed portions of said part, said reflective plate means having inside surface with multiple of cube corner reflective elements, said reflective plate means having an outside surface with planar transparent surface to intercept light from incoming traffics.

20. The reflective roadway marker as defined in claim 19, wherein two parts with dissimilar color can be welded at the vertical backside to form a multi colored reflective marker, said marker having corresponding transparent colored reflective plate means attached to each part.

21. The reflective roadway marker as defined in claim 19, wherein each part of the one piece body integrally having multiple hollow cavities, each hollow cavity having a centerline near perpendicular to the corresponding inclined planar face surface, said reflective plate means sonically welded to said wedge shaped top surfaces of said open ends of load carrying partition walls defining said hollow cavities within said inclined recessed portion of said inclined planar face.

22. The reflective roadway marker as defined in claim 19, wherein each part having multiple of hollow cavities within the vertical backside, said hollow cavities formed to improve said structural body and minimize production cycle time for said body.

23. The reflective roadway marker as defined in claim 19, wherein the outside surface of the reflective plate means can be coated with an abrasion resistant film, said film could be either silicon dioxide or diamond like carbon film, utilizing suitable vapor deposition method.

* * * * *